United States Patent [19]

Kessler

[11] Patent Number: 4,608,924

[45] Date of Patent: Sep. 2, 1986

[54] ELIMINATION OF INK SPLATTERING DUE TO STATIC FRICTION IN ROTOGRAVURE PRINTING

[75] Inventor: Robert G. Kessler, New Brighton, Minn.

[73] Assignee: Champion International Corporation, Stamford, Conn.

[21] Appl. No.: 578,984

[22] Filed: Feb. 13, 1984

Related U.S. Application Data

[63] Continuation-in-part of Ser. No. 506,851, Jun. 24, 1983, abandoned, which is a continuation of Ser. No. 352,112, Sep. 25, 1982, abandoned, which is a continuation of Ser. No. 185,174, Sep. 8, 1980, abandoned, which is a continuation-in-part of Ser. No. 927,174, Jul. 21, 1978, abandoned.

[51] Int. Cl.[4] ..... B41F 9/00

[52] U.S. Cl. ..... 101/170; 101/153

[58] Field of Search ..... 101/152, 153, 154, 170, 101/216, 228, 217, 219, 178, 426; 260/DIG. 18

[56] References Cited

U.S. PATENT DOCUMENTS

| | | | |
|---|---|---|---|
| 2,654,315 | 10/1953 | Huebner | 101/426 X |
| 3,060,853 | 10/1962 | Remer | 101/157 |
| 3,909,469 | 9/1975 | Miller | 260/15 |
| 3,976,719 | 8/1976 | Labana et al. | 260/17 R |

OTHER PUBLICATIONS

Reference Encyclopedia of Flexographic Equipment and Supplies, Robert P. Lung, North American Publ. Co., Philadelphia, Penn., 1974, pp. 101–103.

*Primary Examiner*—J. Reed Fisher

*Attorney, Agent, or Firm*—Evelyn M. Sommer; William W. Jones

[57] ABSTRACT

The splattering of ink droplets in rotogravure printing onto plastic film is eliminated by an improved rotogravure process. There is applied to the surface of the rubber impression cylinder, a coating of a polymeric substrate which is triboelectrically more positive than the plastic film which is to be printed. When the coated impression cylinder makes contact with the plastic film, a negative charge is triboelectrically imparted to said film, thereby eliminating the static attraction between the film and the negatively charged ink.

6 Claims, 2 Drawing Figures

ELIMINATION OF INK SPLATTERING DUE TO STATIC FRICTION IN ROTOGRAVURE PRINTING

This application is a continuation-in-part of copending application Ser. No. 506,851 filed June 24, 1983, now abandoned, which is a continuation of application Ser. No. 352,112 filed Sept. 25, 1982 and now abandoned, which is a continuation of application Ser. No. 185,174 filed Sept. 8, 1980 now abandoned, which is a continuation-in-part of application Ser. No. 927,174 filed on July 21, 1978 and now abandoned.

This invention relates to rotogravure printing, also known as intaglio printing. More particularly, it relates to an improved rotogravure printing process for plastic films in which ink splatter due to static electrical charges is avoided.

Rotogravure printing is a well-known process in which a sheet, such as a paper web or a plastic film is drawn between two cooperating cylinders. The first cylinder is an intaglio or etched cylinder which is caused to pick up ink in image configuration. The second cylinder is an impression cylinder, commonly of rubber or rubber-like material, and the sheet to be printed is drawn between the two cylinders. The static splatter which occurs in rotogravure printing is a well-known phenomenon. When sheet materials, particularly polyester or other plastic materials, are printed, they are rubbed by the rubber material on the impression cylinder and a positive charge triboelectrically develops on the film. The ink contained on the etched cylinder normally has a negative charge. Since unlike charges attract each other, the breaking ink film is attracted by the adjacent unprinted areas of the plastic sheet and "splattering" occurs. This splattering phenomenon is due to static frictional forces and in order to overcome the problem, it would appear that the unlike electrical charges due to static friction which causes the splattering should be eliminated.

The primary object of this invention, therefore, is to provide a process for eliminating splattering due to static friction. Other objects of the invention will be apparent from a consideration of the following description of the invention.

SUMMARY OF THE INVENTION

An improved rotogravure printing process employs a rubber impression cylinder which is coated on its surface with a polymeric substance more triboelectrically positive than the plastic film to be printed. When the coated impression cylinder is rubbed by the plastic film during the printing process, a negative charge is triboelectrically imparted to the plastic film. The negatively charged ink is not attracted to the unprinted portions of the resulting negatively charged plastic film and thus splattering due to static friction is eliminated.

Figure 1:
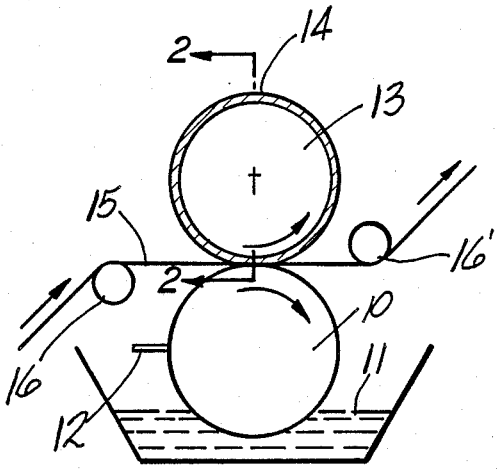
FIG. 1 is a diagrammatically shown rotogravure printing apparatus employed in the process of the present invention.

These drawings will be discussed in more detail below.

DETAILED DISCLOSURE

The splattering of ink caused by static friction, a phenomenon also known as "static tails", has long been a problem in rotogravure printing of plastic film material, particularly polyester films.

In U.S. Pat. No. 3,060,853, it is taught that static electricity may be reduced by forming the impression cylinder of a rubber material which is electrically conductive. The cylinder is connected to an electrical ground in order to maintain a neutral charge. Other methods of alleviating the static friction problem have involved the use of aerosol sprays, ionized air devices, air guns, induction bars, etc. These various methods all possess one or more disadvantages such as required frequency of application, additional equipment, etc.

The present invention employs the phenomenon of triboelectricity, i.e., the electrical charge generated by the rubbing of two objects together, to eliminate static splattering on rotogravure printed plastic films. The prior art combination of polyester and other plastic film material and the rubber of rubber-like material used on the surface of the impression cylinder employed in rotogravure printing have been such that a positive static charge develops on the plastic film during the printing process. Since the ink applied onto the film has a negative charge, the ink is attracted to the adjacent unprinted areas of the polyester film, causing unsightly splattering. In the present invention, there is applied to the rubber cylinder a coating of a polymeric substance which is more triboelectrically positive than the plastic film. When the coated cylinder comes in contact with the plastic film, a negative charge is imparted to the plastic film and there is no longer the attraction for the negatively-charged ink particles.

The rubber materials employed on the impression cylinders of the apparatus used in the present invention can be the usual rubber materials employed in rotogravure printing processes. These include natural rubber, synthetic isoprene, reclaimed rubber, chlorinated rubber, polybutadiene, cyclized rubber, butadiene-acrylonitrile rubber, nitrile rubber, butadiene rubber, butyl rubber, neoprene rubber and the like. Virtually any type of rubber or rubber-like material of satisfactory durability can be used as long as it is capable of being the substrate for an appropriate polymeric coating.

Triboelectrification is essentially electrification by friction and has been known since ancient times. There is unfortunately, no single "triboelectric series", i.e. a list in which the sign of the charge developed on a given surface by contact with another can be predicated from the relative positions of the two materials in the series. Various workers in the art have published triboelectric series which contain commercially produced synthetic polymers. A suitable triboelectric series for the purpose of this invention is:

(positive end)

Polyethylene Imine
Gelatin
Polyvinyl Acetate
Nylon
Polybutyl Methacrylate
Polycation (DuPont Zelec DX)
Quadrol crosslinked polyurethane
Polyacrylamide
Polyacrylic Acid Polyethylene Terephthalate
Neoprene Rubber
Natural Rubber
Polystyrene
Polyethylene
Polytetrafluorethylene Many other triboelectric series have been published by such as, for example, J. Henniker in *Nature* 196, 474 (1962), G. S. Rose and S. G. Ward in *Brit. J. Appl. Phys.* 8, 121 (1957) and E. Fukada and J. F. Fowles in *Nature* 181, 693 (1958). Many such lists include natural substances such as window glass, woven silk, wool, etc., and are therefore somewhat indefinite. The foregoing list is therefore limited to commercially available products which can be considered suitable for use in the practice of this invention.

In the foregoing list (as in other triboelectric series lists), polytetrafluoroethylene, polyethylene, and polystyrene are grouped at the negative end, i.e., these materials tend to acquire negative charges from materials higher on the list. On the other hand, nylon and polybutylmethacrylate are found at the positive end of the series, acquiring positive charge from materials lower on the list. It should be noted that polyethylene terephthalate, commonly known as "polyester", to which the instant invention is particularly applicable as a film to be printed is located somewhat in the lower middle section of the list. Thus, when polyester is rubbed by other polymeric materials higher in the list, for example, a rubber impression cylinder coated with such polymeric material, the polyester will acquire a negative charge. Such polymeric material suitable for coating the impression cylinder when the film to be printed is polyester include the various polymeric substances higher in the list and other substances not specifically listed here which are triboelectrically more positive than polyester. These include, for example, crosslinked polyethyleneimines, Quadrol, a trademark of Wyandotte Chemical Corp. for N,N,N',N'-tetrakis(2-hydroxypropyl)ethylenediamine crosslinked polyurethane, polyvinylacetate and nylon.

It will be noted that nylon, to which the process of this invention is also applicable, is somewhat higher in the triboelectric series than polyester. Thus, the choice of polymeric coating to be placed on the rubber impression cylinder is somewhat smaller when nylon films are to be printed. With nylon, one can use, for example, crosslinked polyethyleneimine (Miller 022-E) and polyvinyl acetate.

Although, in theory, there can be used as the cylinder coating any polymeric substance more triboelectrically positive than the plastic film which is to be printed, in practice, it is necessary to choose a coating which not only has the proper triboelectric properties but also is sufficiently durable in the process conditions of rotogravure printing. For example, polyethyleneimine is more triboelectrically positive than polyester and, when coated onto a rubber impression cylinder would impart a negative charge to the polyester film. However, polyethyleneimine is not sufficiently durable under rotogravure process conditions and it is necessary to modify the polyethyleneimine, i.e., to produce a crosslinked polyethyleneimine, in order to provide the required durability.

Particularly suitable rubber impression cylinders are made of neoprene rubber. The rubber surface can, if necessary, be treated by, for example, oxidizing with a flame in order to improve adhesion of the coating.

Friction produced during the rotogravure process produces a charge between dissimilar materials. The amount of impression required for rotogravure printing produces a deflection of the rubber cylinder causing a sliding or movement of the rubber on the film as the rubber expands and contracts under pressure. This amount of deflection to provide minimum print quality is sufficient to produce the desired charge on the film. A typical rotogravure press speed is 350 feet per minute, and it is not likely that varying this speed would have any significant effect on static charges building up during the process. Similarly, varying the thickness and/or resiliency of the rubber on the cylinder would have little or no effect on the static charges since we are dealing essentially with surface phenomena.

Referring now to FIG. 1 of the drawings, the rotogravure press unit comprises an intaglio or etched cylinder 10 alternatively dipping into ink supply 11 with the amount of ink remaining on the image portions of cylinder 10 being regulated by a low-friction fountain knife or doctor blade 12. The impression cylinder 13 which cooperates with etched cylinder 10 is made of rubber or a rubber-like material and coated with a polymeric substance 14 which is more triboelectrically positive than the plastic film 15 to be printed. The plastic film 15 is passed through the printing unit between etched cylinder 10 and impression cylinder 13 by means of guide rollers 16 and 16'.

Figure 2:
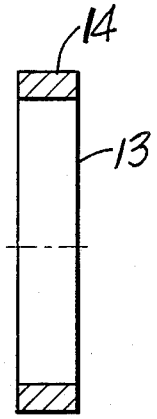
FIG. 2 is an enlarged fragmentary sectional view taken along a line 2—2 of FIG. 1.

In FIG. 2 of the drawings, which is a fragmentary sectional view along the line 2—2 of FIG. 1, rubber impression cylinder 13 is shown coated by polymeric substance 14.

The thickness of the coating 14 will depend upon such factors such as the particular polymeric substance used and its durability under rotogravure printing conditions. Typically, the thickness of such film should be at least about 0.035 pounds per 3,000 square feet, preferably between 2.0 and about 10.0 pounds per 3,000 square feet.

The invention will be better understood by reference to the following example, which is set forth here for the purpose of illustration only and is not to be intended as a limitation.

EXAMPLE

Rotogravure printing was conducted with a film of polyethylene terephthalate and an impression cylinder made of neoprene rubber coated with Miller 022-C, a crosslinked polyethyleneimine manufactured by the Miller Process Company, applied at 2.5 pounds per 3,000 square feet. Further information regarding Miller 022-C may be found in U.S. Pat. No. 3,909,469, pertinent portions of which are incorporated herein by reference. The printing was conducted for approximately twenty hours and approximately 584,000 feet of material was printed. No evidence of static splatter was observed. A conventional uncoated neoprene roll utilized under identical process conditions produced a significant amount of static splatter.

What is claimed is:

1. A method for eliminating static-induced splattering of negatively charged ink in the printing of plastic films, said method comprising the steps of:

(a) providing a roller for frictionally engaging the film being printed, said roller being coated with a surface layer of a suitably durable polymeric substance which is more triboelectrically positive than the plastic film being printed, said surface layer of said polymeric substance being of a thickness which is at least about 0.035 pounds per 3,000 square feet;

(b) frictionally engaging said film and said coated roller to impart a negative static electric charge to said film; and (c) thereafter printing said negatively charged film with said negatively charged ink.

2. The method of claim 1 wherein said coated roller is a rubber impression cylinder.

3. The method of claim 1 wherein said polymeric substance layer has a thickness in the range of about 0.035 pounds per 3,000 square feet to about 10.0 pounds per 3,000 square feet.

4. The method of claim 1 wherein said polymeric substance layer has a thickness of about 2.5 pounds per 3,000 square feet.

5. The method of claim 1 wherein said polymeric substance is a cross-linked polyethylene imine.

6. The method of claim 5 wherein said plastic film is polyethylene terephthalate.

* * * * *